United States Patent [19]

Naito

[11] 4,063,873

[45] Dec. 20, 1977

[54] INFRARED GAS BURNER PLATE

[75] Inventor: Susumu Naito, Nagoya, Japan

[73] Assignee: Rinnai Kabushiki Kaisha, Nagoya, Japan

[21] Appl. No.: 733,947

[22] Filed: Oct. 19, 1976

[30] Foreign Application Priority Data

Oct. 20, 1975 Japan ..... 50-125372

[51] Int. Cl.[2] ..... F23D 13/12

[52] U.S. Cl. ..... 431/328

[58] Field of Search ..... 431/328, 329; 239/557

[56] References Cited

U.S. PATENT DOCUMENTS

| | | | |
|---|---|---|---|
| 3,170,504 | 2/1965 | Lanning | 431/328 |
| 3,558,252 | 1/1971 | Roca | 431/328 |
| 3,954,387 | 5/1976 | Cooper | 431/328 |

*Primary Examiner*—Carroll B. Dority, Jr.
*Attorney, Agent, or Firm*—Haseltine, Lake & Waters

[57] ABSTRACT

An infrared gas burner plate comprising a plate member of ceramic provided with a large number of burner holes therein distributed over the entire surface thereof. The burner plate has a front surface with a plurality of diamond-shaped concave portions continuously formed in the front surface. Each of the concave portions has a burner hole in the center thereof and a plurality of burner holes arranged around the center hole in an annular arrangement. Two holes are diametrically placed outside the holes in the annular arrangement.

6 Claims, 4 Drawing Figures

INFRARED GAS BURNER PLATE

FIELD OF THE INVENTION

This invention relates to a burner plate formed mainly of ceramic and used as a gas combustion device.

BACKGROUND OF THE INVENTION

In a conventional burner plate whose burner surface is concave-convex for improving the heat radiant efficiency, there is produced a great burning noise due to its concave-convex surface.

SUMMARY OF THE INVENTION

An object of the invention is to provide a concave-convex burner surface in which the burning noise is decreased without lowering of the heat radiation efficiency.

According to the invention, diamond-shaped concave portions are continuously formed in the front surface of the ceramic plate member, each of the concave portions being provided with burner holes at its center portion, at an annular portion surrounding the center portion and at portions on both outsides of the annular portion.

Embodiments of this invention will next be described with reference to the accompanying drawings.

DETAILED DESCRIPTION

Figure 1:
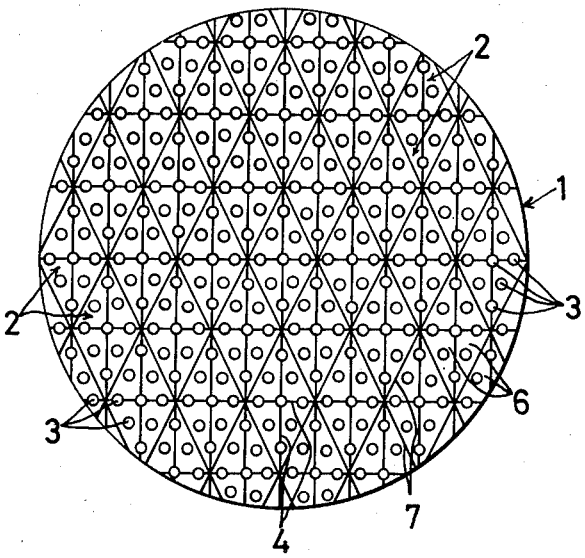
FIG. 1 is a top plan view of a burner plate according to the invention.
Figure 2:
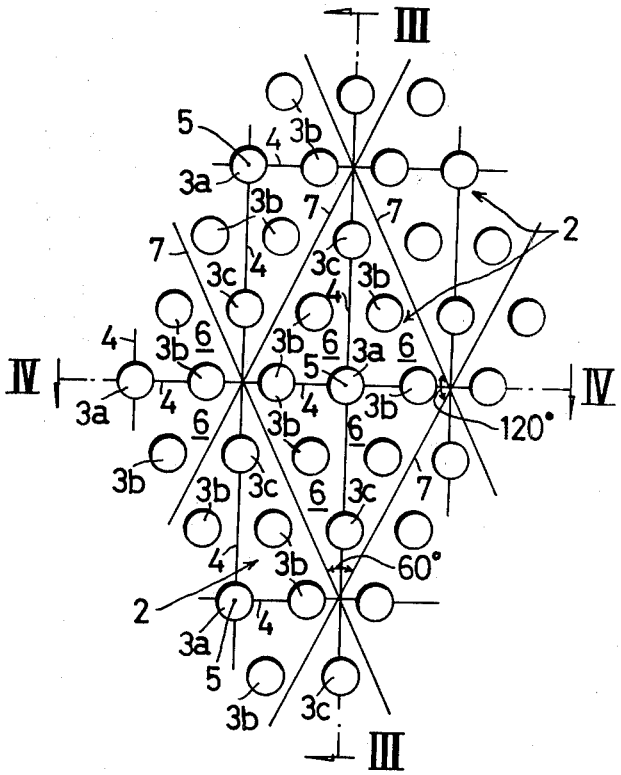
FIG. 2 is an enlarged top plan view of a portion of the burner plate.

Referring to the drawings, numeral 1 denotes a burner plate which is composed mainly of ceramic and is a fine porous one formed by sintering for improving its heat insulation and its infra-red heat effect.

Figure 3:
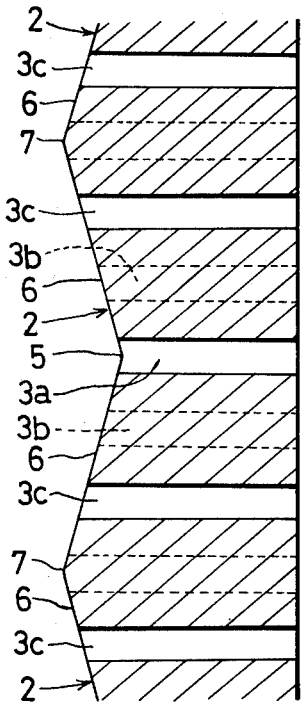
FIGS. 3 and 4 are sectional views respectively taken along lines III — III and IV — IV in FIG. 2.
Figure 4:
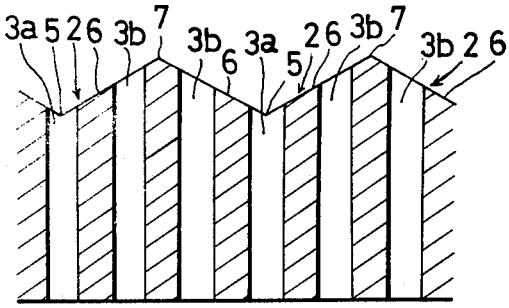

Numeral 2 denotes a diamond-shaped concave portion i.e. concave in mutually perpendicular directions as seen in FIGS. 3 and 4, and a large number of concave portions are formed over the entire surface of the burner plate 1. Each of the concave portions 2 comprises four triangular surfaces 6 with a common lower point of intersection 5 of two diagonal lines 4 thereof. These diamond-shaped concave portions 2 which are all equal in size and shape are continously formed in the surface of the burner plate 1 such that each of the four sides, i.e. ridge lines forming the boundary lines of each diamond-shaped concave portion 2 is common to the neighboring concave portion 2, and thus all of the ridge lines 7 forming the boundary lines of the diamonds are continued one to another in such a condition that respective parallel lines extending in two directions cross one another over the entire surface of the burner plate 1.

Numeral 3 denotes a burner hole through the burning plate 1 between the front and rear surfaces thereof and a large number of holes 3 are distributed over the entire surface of the plate 1. The size of the holes is determined by the components of the combustion gas to be used but it is optimum for the holes to be about 1 mm in diameter. It is preferable that the depth of each diamond-shaped concave portion 2 does not exceed two times the diameter of the burner hole 3.

The illustrated construction is an optimum embodiment of this invention and in this embodiment, each of the diamond-shaped concave portions 2 in the surface of the burner plate 1 has respective opposite interior angles of 60 degrees and 120 degrees, and the burner holes 3 are distributed in each concave portion 2 to be nine in total, comprising a single hole **3*a* positioned at the center of intersection of the diagonal lines 4 of the diamond, six holes 3*b* distributed at regular intervals on a circular annular portion, including two holes positioned on the short diagonal line 4 on both sides of the center, and two holes 3*c* each positioned on the long diagonal line 4 outside the foregoing annular portion. All adjacent three burner holes 3 are disposed to form an equilateral triangle, and all the burner holes 3 on the whole surface of the burner plate 1** are distributed uniformly.

Of course this invention is not limited to the foregoing embodiment and may be considered to include arrangement in which each diamond-shaped concave portion has each interior angle equal to 90° and any suitable number of burner holes are distributed in each concave portion in a predetermined distribution thereof.

The combustion condition of the gas in the burner plate of this invention is as follows:

The burnt exhaust gas flowing upwards in each burner hole 3 is released from the compressive pressure within the hole and is expanded in volume at the moment that the gas flows out of the opening end of the burner hole 3, and the expanded exhaust gas is in contact at its side with the adjacent similar exhaust gas and these gases are mutually accelerated in their speed flowing in the upward direction while pushing against one another.

The exhaust gases discharged from the burner holes **3*b* distributed along the annular portion surrounding the center portion burner hole 3*a* are concentrated towards the center so as to fill an annular space for producing an upward rapid flow directed upwardly towards the center portion. The flow speed thereof is greater than the flow speed of the gas flowing within each burner hole, so that the exhaust gas discharged from the center portion burner hole 3*a* which is located lower than the burner holes 3*b* located in the foregoing annular space is sucked by the foregoing rapid flow so as to be carried away upwards. The sucking speed is higher than the flowing speed of the exhaust gas discharged from the center portion burner hole 3*a*, so that the exhaust gas discharged from the center portion burner hole 3*a* is pulled upwardly at the opening end of the burner hole 3*a*** resulting in a "lift" phenomenon. This phenomenon brings about the condition that the burning flame is positioned in upwardly spaced relation from the opening end in facing relation to said opening end, and the burning boundary region thereof is extemely unstable and assumes a vibrating condition, and thus the vibration of the burning boundary region of a circular form which is within the annular space and is considered to be similar to the annular form of the space generates a substantial burning noise.

This condition is almost the same as that in the conventional burner plate, but according to this invention there are additionally provided the diametrically opposed burner holes **3*c* outside the annularly disposed burner holes 3*b* encircling the center portion burner hole 3*a***, so that the exhaust gases discharged therefrom are caused to participate in the foregoing annular exhaust gas region, whereby the balancing expansion pressures directed towards the center of the annular exhaust gases act thereon to bias the flow from both sides. Thus, the pressure range of the circular form which appears to be similar to the annular form is compressed from both sides along a line connecting the burner holes 3*c* so that the circular form is deformed into a flat form extending in a direction at right angles to the foregoing connecting line, whereby the burning noise is decreased in spite of the burning vibration which is being generated.

According to this invention, the infra-red heat degree of the burner plate can be intensified by the high temperature of the mutual exhaust gases in addition to the heat around the opening end of each burner hole by the burning gas in each diamond-shaped concave and thereby a strong heat radiation can be obtained throughout the entire surface of the burner plate, while additionally the burning noise can be decreased substantially without adversely affecting this heat radiation effect.

What is claimed is:

1. A gas infrared burner plate comprising a plate member of ceramic provided with a large number of burner holes therein distributed over the entire surface thereof, said burner plate having a front surface with daimond-shaped concave portions continuously formed in said front surface, each concave portion having one said burner hole in a center portion, a plurality of said burner holes in an annular arrangement surrounding the center portion and a plurality of said holes outside said annular portion.

2. A gas infrared burner plate according to claim 1, wherein said holes outside said annular portion are in diametric opposition to one another.

3. A gas infrared burner plate according to claim 1, wherein each of the diamond-shaped concave portions comprises four surfaces extending from the center of the diamond-shaped portion to four edges of the diamond-shaped portion, each diamond-shaped concave portion being equal in size and shape to neighboring portions and having one edge common to a side of a neighboring portion.

4. A gas infrared burner plate according to claim 1, wherein the burner holes each has a diameter of about 1 mm and the diamond-shaped concave portions each has a depth which is a maximum of two times the diameter of a burner hole, said burner holes being spaced at regular intervals.

5. A gas infrared burner plate according to claim 1, wherein the diamond-shaped concave portions each has respective opposite interior angles of 60° and 120°, the burner holes in each concave portion comprising one positioned at the center portion, six disposed at regular intervals in the annular arrangement and two disposed outside said annular arrangement and along the long diagonal of the diamond-shaped portion.

6. A gas infrared burner plate according to claim 5, wherein two of the holes in said annular arrangement are disposed on the short diagonal of the diamond-shaped portion.

* * * * *